US009802754B2

(12) United States Patent
Navalon Simon

(10) Patent No.: US 9,802,754 B2
(45) Date of Patent: Oct. 31, 2017

(54) COLLAPSIBLE CONTAINER

(71) Applicant: Miguel Antonio Navalon Simon, Valencia (ES)

(72) Inventor: Miguel Antonio Navalon Simon, Valencia (ES)

( * ) Notice: Subject to any disclaimer, the term of this patent is extended or adjusted under 35 U.S.C. 154(b) by 0 days.

(21) Appl. No.: 14/896,985

(22) PCT Filed: Jun. 3, 2014

(86) PCT No.: PCT/ES2014/000092
§ 371 (c)(1),
(2) Date: Feb. 11, 2016

(87) PCT Pub. No.: WO2014/202802
PCT Pub. Date: Dec. 24, 2014

(65) Prior Publication Data

US 2016/0251153 A1 Sep. 1, 2016

(30) Foreign Application Priority Data

Jun. 18, 2013 (ES) ..... 201300590

(51) Int. Cl.
*B65D 6/00* (2006.01)
*B65D 88/52* (2006.01)

(52) U.S. Cl.
CPC ..... *B65D 88/522* (2013.01)

(58) Field of Classification Search
CPC . B65D 1/22; B65D 1/225; B65D 1/26; B65D 9/12; B65D 9/22; B65D 11/18; B65D 19/12; B65D 19/16; B65D 21/086; B65D 51/08; B65D 61/00; B65D 88/52; B65D 88/522
USPC ..... 220/6, 1.5, 666, 668, 669, 670, 7, 4.28, 220/4.29, 812, 826; 206/600; 217/12 R, 217/13, 14, 15, 16
See application file for complete search history.

(56) References Cited

U.S. PATENT DOCUMENTS 3,799,384 A 3/1974 Hurkamp
4,684,034 A * 8/1987 Ono ..... B65D 7/24 220/1.5
7,703,632 B2 * 4/2010 Kochanowski ..... B65D 88/005 217/12 R (Continued)

FOREIGN PATENT DOCUMENTS

EP 2036835 3/2009
EP 2132111 12/2009

(Continued)

*Primary Examiner* — Kareen Thomas
(74) *Attorney, Agent, or Firm* — Ladas & Parry LLP

(57) ABSTRACT

The object of this invention refers to a new foldable container in a parallelepiped shape with all sides being rigid and flat, fitted with an articulation and guiding system that permits folding of the sides over the base in an opposing manner through the turning of one end and sliding of the other towards the inside of the container, only through vertical movement of the roof. It permits the use of conventional doors half the width of the container. The improvements account for an innovative system that permits the folding/unfolding movement without substantially modifying certain characteristics of conventional ISO containers. The design caters for container versions where the doors are higher than the width of the container.

17 Claims, 18 Drawing Sheets

(56) References Cited

U.S. PATENT DOCUMENTS

| | | | | |
|---|---|---|---|---|
| 7,870,970 | B2 * | 1/2011 | Fisk | B65D 88/022 220/4.28 |
| 7,984,819 | B1 * | 7/2011 | Davis | B65D 88/524 220/1.5 |
| 8,113,372 | B2 * | 2/2012 | Bellehumeur | B65D 88/524 220/1.5 |
| 8,308,018 | B2 * | 11/2012 | Kochanowski | B65D 88/005 217/12 R |
| 8,646,638 | B2 * | 2/2014 | Buskermolen | B65D 88/522 220/1.5 |
| 9,517,879 | B2 * | 12/2016 | Chawla | B65D 88/526 |
| 2008/0029510 | A1 * | 2/2008 | Fisk | B65D 88/022 220/7 |
| 2010/0018967 | A1 | 1/2010 | Schrayvogel | |
| 2010/0102056 | A1 * | 4/2010 | Bellehumeur | B65D 88/524 220/6 |
| 2011/0284533 | A1 | 11/2011 | Kochanowski | |
| 2012/0061390 | A1 * | 3/2012 | Giesbers | B65D 90/008 220/7 |
| 2012/0248105 | A1 * | 10/2012 | Leong | B65D 88/524 220/7 |

FOREIGN PATENT DOCUMENTS

| | | |
|---|---|---|
| GB | 2353275 | 2/2001 |
| WO | 2006020927 | 3/2006 |
| WO | 2008114273 | 9/2008 |
| WO | 2008122984 | 10/2008 |
| WO | 2009038518 | 3/2009 |

* cited by examiner

COLLAPSIBLE CONTAINER

OBJECT OF THE INVENTION

The object of this invention is to provide shipping transport and highway and railway transport, or any other sector in which containers are used, with a new container that can be folded away when it is empty, thus reducing the use of space and transport and storage costs. Furthermore, the new foldable container proposed in this invention meets the conditions demanded by the logistics chain in order to replace conventional containers.

TECHNICAL SECTOR

This invention is covered within the industrial sector of goods container construction and the logistics and distribution sectors.

INVENTION BACKGROUND

In shipping transport, there is a major imbalance between net import and net export regions which means that many shipping vessels travel with empty containers. The bibliography consulted, indicates that these percentages could oscillate between 20% and 30% of the world's container transport on the sea. This fact leads to major economic losses for the sector and an environmental problem of astronomical proportions. A collapsible container could be a good solution to this problem. This solution could affect container shipping transport, but also highway and railway transport.

The state of the art features different collapsible container systems, although as described in this document, there are some obstacles for manufacturing and marketing them because of their complexity or as a result of the collapsible design itself which means accessibility to or space within the container is lost.

The U.S. Pat. No. 3,799,384, Collapsible shipping container with application date 28 Feb. 1972 describes a collapsible transport container that has a lower edge of a side wall pivoting on one side of the base with the upper edge of the same side wall fixed to the upper part of a roller assembly, and the upper edge of the other wall pivoting on the other side of the upper part with the lower edge of the same side wall secured to the base by another assembly of rollers.

The roller assembly on the guide permits the upper edge of the side wall to move laterally one way, while the other set of rollers permits the lower edge of the other side wall to move laterally on the base in the opposite direction.

The opposing movements guided by the upper edge of one side wall and the lower edge of the other side wall permit the upper part to move downwards towards the base, while the collapsible transport container is being folded down.

Nevertheless the aforementioned patent U.S. Pat. No. 3,799,384 does not provide a satisfactory solution for different aspects:

- The proposed joint and guide system is only compatible with side walls and doors smaller than the standard for conventional ISO containers.
- In order for excentric turning to take place with regards the plane of the side walls, the turning point is moved through a catch towards the inside of the container (identified in the document as Number 41) which, when the doors are open, is an obstacle that occupies useful space and hinders entrance to the container, which could lead to incidents during loading/unloading with the subsequent problem of damages to the folding/unfolding system, or a loss of useful capacity in the storage space. This obstacle invades the useful load space, and obviously this circumstance is not true in the case of conventional ISO containers.
- The collapsible system is only compatible with one single door which opens to one side only (identified in the document as Number 104), while conventional ISO containers comprise two doors which open to both sides, each one accounting for half the width of the container opening outwards.
- The existence of one single door opening to one side is due to the need for the collapsible axis to be fitted to one of the side walls in a position that does not coincide with the joint between the wall and the floor, forcing the solution identified in the document under Number 23.
- The door opening inwards is necessary so that the folding of the container can take place without collisions between the different parts.
- It is a collapsible system that is only compatible with double folding hinged doors that allow opening of the container outwards, but also opening inwards to allow the folding mechanism to take place. The doors on standard ISO containers only open outwards. The double doors make construction of containers more expensive and jeopardise correct maintenance thereof.
- It is not clear how the position of the dead point is overcome before starting the folding action, and if any manual intervention by a person is required to overcome it. The folding movement can apparently not be initiated automatically with the vertical movement of the roof towards the base.
- Closing and sealing of the door is complicated since, owing to the fact that the door has to turn inwards to the container, the conventional stepped frames between the floor and the doors cannot be made that guarantee a seal. Double lip seals must be fitted to the door, which complicate maintenance significantly with movement of the container doors in both directions.

These aspects mean that this technological innovation, in spite of featuring a more simple folding/unfolding movement than other collapsible container options, has not had any technological repercussions in the market, making it a successfully marketed product in the logistics chain.

The container comprising the object of this invention is easy to convert from the usable position, where all the side walls are vertical and the roof rests over them, to a folded position where the side walls and roof lie over the floor, with the aforementioned impediments or restrictions being eliminated.

The patent GB2353275A, Collapsible container body with application date 19 Aug. 1999, reproduces the folding/unfolding movement of the U.S. Pat. No. 3,799,384, but with a securing and turning system at the joint areas that invade the outer limits of the container itself, which is entirely intolerable in the concept of standard ISO containers, where the standardisation rules, mainly in terms of standard measurements, are extremely rigid. Another patent that proposes a solution for folding down containers is US patent 20100018967, Folding container with PCT application date 28 Feb. 2007, although this patent features roll-up doors, which to our understanding are completely incompatible with the folding system and the watertight requirements of shipping containers to be included in the logistics chain. These items completely invalidate it as a folding container solution for implementation.

The technological innovation this invention comprising the object of this patent represents makes it possible to adopt folding/unfolding movement via a combination of turn and slide of the side walls as in the three patents mentioned previously, but resolving the problematic aspects of said patents mainly in terms of the solution to the container doors, since this makes the folding/unfolding movement compatible with the door solution in conventional containers.

Other more recent patents such as WO2008114273, A folding/unfolding transport container and a method of folding and unfolding a transport container, with priority date 21 Mar. 2007, patent EP 2036835, Foldable container with application date 13 Sep. 2007, the American patent US 20110284533, Stackable and collapsible container, with application date 2 Sep. 2012, or the European patent EP 2132111, An apparatus and method for folding and unfolding a foldable transport container with application date 17 Mar. 2008 propose folding containers with different folding mechanisms, emphasising the interest there is in the sector to find a container that can be folded.

The state of the art does not contemplate a technical solution such as the one described in this patent, which takes different aspects considered suitable to attain compliance with the expectations of the sector.

DESCRIPTION OF THE INVENTION

This inventions centres its application of a new folding container, with a parallelepiped shape with all sides rigid and flat, featuring a mechanism of joints or connection nodes and guides that permit folding down of the sides over the floor via vertical shifting of the roof piece.

From the state of the art it is obvious that there is huge interest in finding a folding container that can be incorporated in the logistics chain to replace conventional containers, allowing the volume of the container to be minimised, via folding, when it is empty. The objective is to save space and transport and storage costs of empty containers. If, furthermore, empty containers can be handled in stacks, once folded away, the loading and offloading operations will be reduced, with the subsequent economic savings.

The object of this invention is to provide a folding container that meets all the conditions required by the logistics chain in order to replace conventional containers:

- This should also entail the minimum possible changes with regards standard ISO containers for the market to accept them without them entailing an unaffordable cost increase.
- Therefore, it should have a moderate acquisition price compared to conventional containers.
- They should be minimally vulnerable to damage that could be caused to them during handling and transport, and this should be easily repairable if produced.
- Easily foldable, minimising the cost of operations that folding/unfolding could entail.
- Compatible universally with all modes of transport and intermodal handling involved in the logistics chain. They should therefore comply with all the conditions of conventional containers with regards to this matter.
- Manageable in stacks once they are folded, so that loading and offloading operations of empty containers can be minimised.
- Achieve the maximum possible reduction. The more the volume is reduced once folded down, the greater economic impact they will have for use in the logistics chain.
- They have to be capable of achieving the relevant international certificates for operating in the logistics chain.

The new folding container comprising the object of the invention is easy to convert from the usable position, where all the side walls are vertical and the roof rests over them, to a folded position where the side walls and roof lie over the floor, FIG. 10. The technical solution for the new container provides the innovation of being foldable, permitting the use of conventional doors of half the container width, opening outwards, so that it can be folded with the movement of the side wall assembly and the doors fixed to the outer side, as described in claim number 1.

Firstly, with a view to better understanding the invention, the technical solutions and the way they work to permit folding and unfolding of the container are described. This invention establishes a locking and unlocking system using conventional elements such as gudgeon pins or pins making the folding movement possible:

The new folding container consists of a roof sheet (1), a floor (2), two sheets comprising the longer side walls (3 and 4) and the front and rear doors of the container (5 and 6). The relative movement of these components permits folding and unfolding through the relevant connection and locking nodes described in this document.

It features at least eight connection nodes (7 and 14), FIG. 4, that connect the roof, floor and side walls, permitting movement in the folding and unfolding of the container by turning and sliding movements of the side walls in conjunction with the use of conventional doors half the width of the container, opening outwards away from the container, that fold jointly with the side walls, FIG. 7.

At least four of the connection nodes permit turning (7), FIGS. 7 and 8, of one end of the side walls, and at least another four connection nodes permit turning and sliding (14), FIGS. 7 and 9, of the opposite end to them, in both cases in conjunction with the doors opened outwards and fixed to the external face of the side walls.

There are two turning nodes (7) on the facing side on two of the corners, diagonally opposite each other, with the turn and slide nodes (14) positioned on the other two corners, FIG. 29. This layout of the connection nodes is repeated on the rear side of the container, and can be reproduced at any intermediate section.

With the container in the unfolded position, i.e. ready to be used for goods and transport, with the walls in the vertical position, the locking mechanism, with gudgeon pins (9 and 10), FIGS. 2, 4 and 5, ensures the rigidity of the edges of contact between the parts of the container, so that the strength of the container is improved against horizontal forces, FIGS. 1 and 11. The container is designed to be fitted with the conventional watertight seals along these lines of contact in order to guarantee the container remains sealed during use.

The turn connection nodes (7), FIG. 5, consist of connection strips (8) with at least two holes, which in combination with at least two conventional gudgeon pins (9 and 10) comprise the locking points. In the raised position the pins are closed against the holes in the strip (8), thus securing the two locking points and producing a butted connection node preventing any turning, FIGS. 12 and 13. In order to enable the folding movement, the pins are removed, FIGS. 19 and 20, so that the locking points are freed, allowing a small vertical movement relative to the side wall with regards the adjacent surface, whether this is the floor or the roof, when the roof is raised using conventional methods such as a crane, FIG. 21, until pin 9 can be closed at the end locking position, FIGS. 22 and 23. With this pin closed in one single anchoring point, the connection becomes a joint that allows a turning movement relative to the side wall with regards the adjacent surface, FIG. 8, whether this is the roof or the floor, and a space equal to the thickness of a side wall plus the attached door is created, which is necessary for the folding of both side walls at the same time, FIG. 30.

The unlocking system of the connection nodes permits the folding movement to be initiated safely, since the container will not fold until we raise the roof after removing the pins, which guarantees safe working conditions for handling by users.

The turn and slide connection nodes (14) at the ends of the side walls opposite the turning nodes (7), FIGS. 1 and 7, consist of conventional means such as a slider (17) with a least one bearing inside the guide (11 and 12) arranged on the side edge of the adjacent surface, whether floor or roof, FIGS. 9, 14, 15, 16 and 17. There are means to overcome the dead point at the start of the movement via a connection strip (15) with a small previous upward vertical movement of the container roof, FIGS. 24, 27 and 28. This connection strip is joined to one end of the slider (17) via conventional means that permit turning, such as a connection rod (18). Moreover, there are means to control the turning of the connection strip, such as angle irons or articulated bars (19). Said connection strip is connected to the side wall via conventional means, such as a bolt that also permits the turning movement (20), FIGS. 25 and 26. This connection node enables folding of the side wall in conjunction with the adjacent door opened onto the outer face, sliding the turn and slide connection node towards the inside of the container without collision between the ends of the assembly and the floor taking place at a node, or with the roof in the diagonally opposite direction.

Once this vertical movement has taken place to produce sufficient space to fold down the walls and doors, the dead point of the start of the folding movement is overcome, and therefore the folding can begin with the turn and slide movement. This automatic overcoming of the dead point of movement permits making the folding movement without the need for intervention by a person, FIGS. 7 and 29.

Once the walls and doors are folded away, and in the horizontal position, there is a locking mechanism through the use of conventional means such as threaded connection rods (24) that permit handling of the folded container without altering its position. Moreover, it permits correct transfer of vertical forces, which means they can be stored normally in the logistics chain with complete resistance safety, FIG. 10.

A version of the invention has been designed for walls higher than the total container width, FIG. 33, as is the case of standard High Cube containers. The openings on the front and rear sides of the parallelepiped that form the floor (2), roof (1) and side walls (3 and 4) are closed by three pieces, articulated at the edges of the parallelepiped. Two of these pieces (5 and 6) are the two doors with height identical to the total width of the container, with the width being half the clear space that open outwards by means of conventional hinges on the vertical edge, permitting outward opening of the doors to a maximum of 270° until they meet the outer facing side of the side wall. The third closing piece (22) is an item that closes the upper part of the opening, covering the entire width of the gap, and which folds on conventional hinges upwards to meet the upper face of the roof if taller goods need to be loaded inside the container, FIG. 39. This additional closing item includes a guide (11) where the slider is fitted (17) for the relevant turn and slide node, FIG. 36. The roof (1) of the parallelepiped moves jointly with the part of the side walls that coincide with the height of the additional closing item (21), with the connection nodes being located in the position of this new, additional closing item, FIGS. 33, 34, 35 and 38.

The folding movement of this new version is carried out in identical fashion to that described previously, with the aforementioned geometrical exceptions, FIG. 40.

In both versions the folding container comprising the object of the invention, once it has been folded, is reduced to dimensions that in the space of a standard container, between four and five folded containers will fit, featuring conventional connection components such as threaded joints, permitting a number of four containers to be handled together as one single unit, FIGS. 31 and 42.

With both versions, the folding container comprising the object of this invention feature means to secure the container in a partially folded position through the use of at least four conventional struts (23), such as threaded bars, attached to the connection nodes so that containers can be secured in the partially folded position. This way, through the use of conventional securing methods, such as threaded bars, a group of at least two containers can be stacked together with the outer volume of a standard container, FIGS. 32 and 43.

BRIEF DESCRIPTION OF THE DRAWINGS

In order to better understand the concepts described in this report, drawings are attached, as examples only, with the relevant description of the figures for the proposed invention.

DESCRIPTION OF FIGURES

Figure 1:
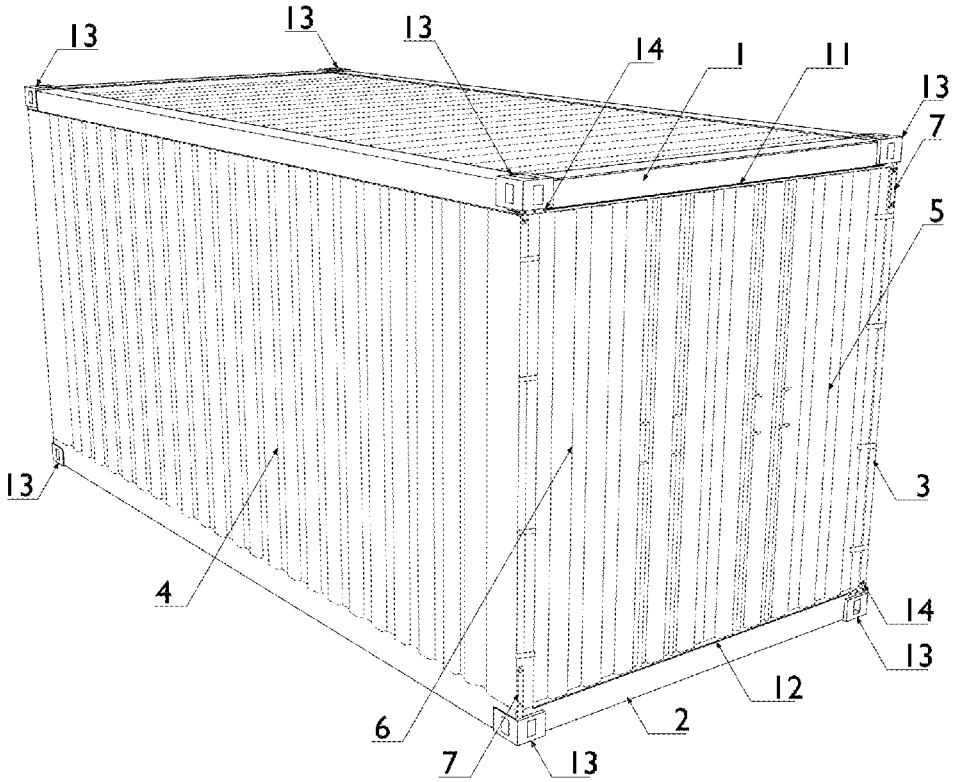

FIG. 1: Three-dimensional view of the unfolded container with the doors (5 and 6) closed, where:

Roof (1), floor (2), long, right hand side wall (3), long left hand side wall (4), right door (5), left door (6), turn connection node (7), sliding guide in the roof (11), sliding guide in the floor (12), corner item for handling and transporting the container (13), turn and slide connection node (14).

Figure 2:
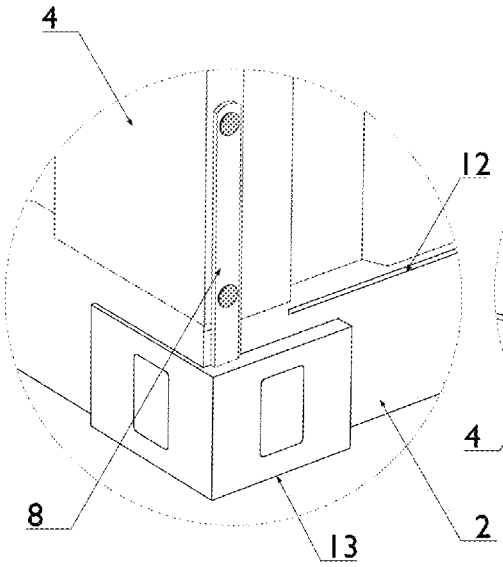

FIG. 2: Detail of the turn connection node (7), in the lower left corner of the front view shown in FIG. 1, where:

Connection strip (8) of the turn node, corner item for handling and transporting the container (13), long left hand side wall (4), sliding guide in the floor (12), floor (2).

Figure 3:
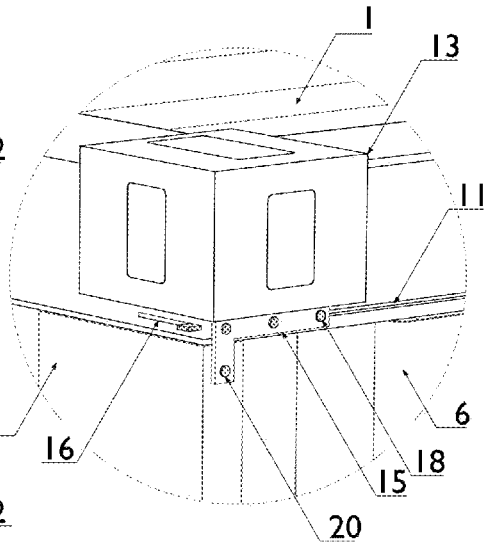

FIG. 3: Detail of the turn and slide connection node (14) in the upper left corner of the front view shown in FIG. 1, where:

Connection strip (15) of the slide node, locking pin (16) of the slide node, turn bolt (18) connecting the slider to the guide (11) and to the connection strip (15), bolt (20) connecting the side wall (4) to the connection strip (15), roof sheet (1), corner item for handling and transporting the container (13), left door (6).

Figure 4:
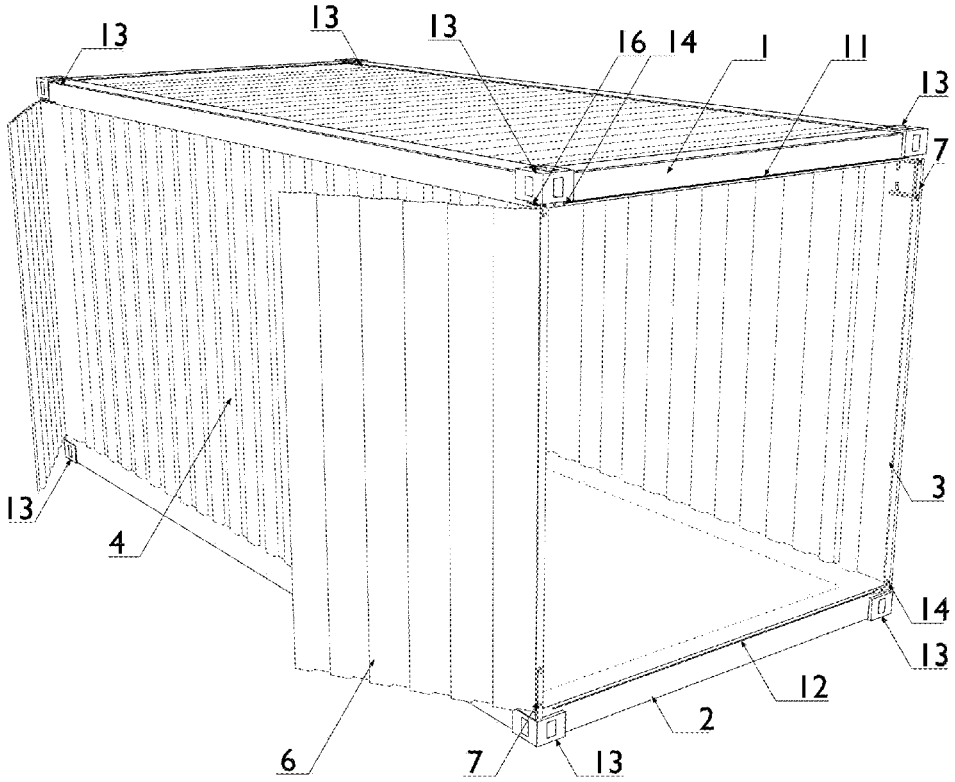

FIG. 4: Three-dimensional view of the unfolded container with the doors open outwards, where:

Roof sheet (1), floor (2), left door (6), long, right hand side wall (3), long left hand side wall (4), turn connection node (7), sliding guide in the roof (11), sliding guide in the floor (12), corner item for handling and transporting the container (13), turn and slide connection node (14), locking pin (16) of the slide node (14), long, right hand side wall (3).

Figure 5:
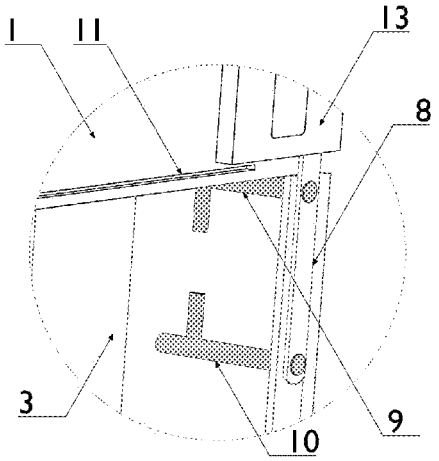

FIG. 5: Detail of the turn connection node, in the upper right corner of the front view of FIG. 4, showing the locking mechanism with gudgeon pins (9 and 10) within the long, right hand side walls (3), where:

Pin (9) preventing the displacement of the turn node, pin (10) preventing turning of the turn node, roof sheet (1), long, right hand side wall (3), sliding guide in the roof (11), corner item for handling and transporting the container (13), connection strip (8) of the turn node.

Figure 6:
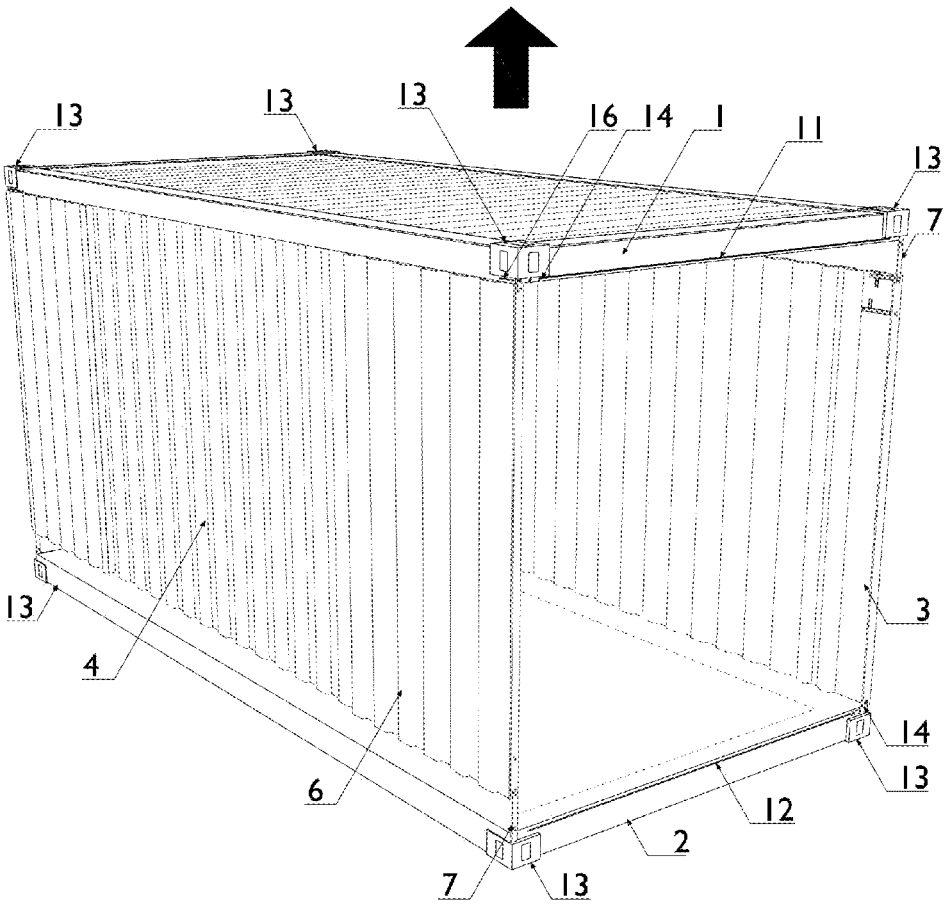

FIG. 6: Three-dimensional view of the container after lifting the roof sheet to unlock the turn node (7), with the doors open outwards and attached to the longer side walls (3 and 4), where:

Roof sheet (1), floor (2), left door (6), sliding guide in the roof (11), sliding guide in the floor (12), corner item for handling and transporting the container (13), turn and slide connection node (14) and locking pin (16) of the slide node.

Figure 7:
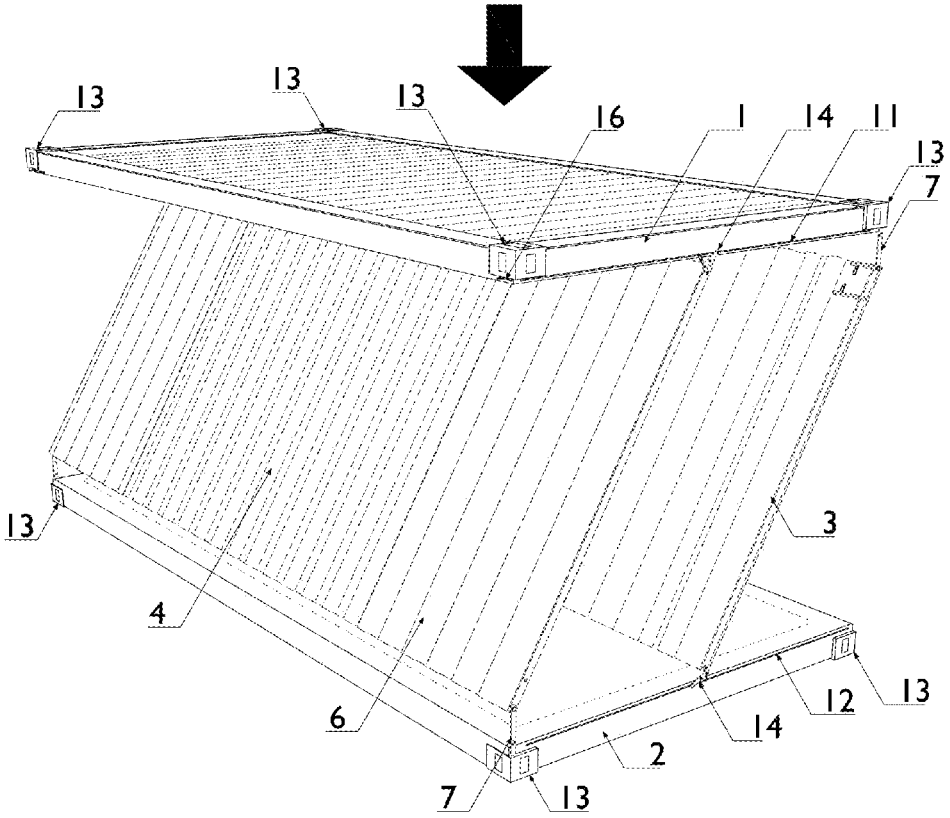

FIG. 7: Three-dimensional view of the container after unlocking the turn nodes (7) and the slide nodes (14), with the side walls (3 and 4) partially folded and the doors open outwards (6) and secured to the outside of the longer side walls through a vertical downwards movement of the roof sheet (1) towards the floor (2), where:

Sliding guide in the roof (11), sliding guide in the floor (12), corner item for handling and transporting the container (13), turn and slide connection node (14), locking pin (16) of the slide node.

Figure 8:
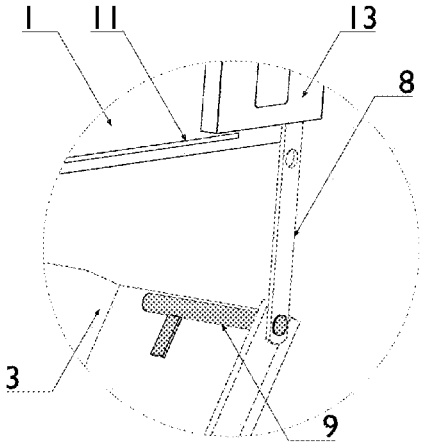

FIG. 8: Detail of the turn connection node in the upper right corner of the front view shown in FIG. 7 showing the gudgeon pin (9) closed against the hole at the end of the strip (8), thus permitting turning, where:

Roof sheet (1), long, right hand side wall (3), sliding guide in the roof (11), corner item for handling and transporting the container (13).

Figure 9:
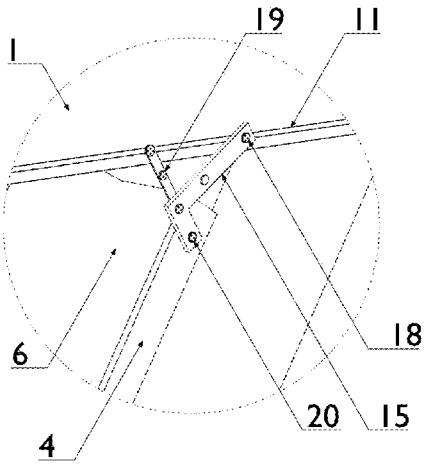

FIG. 9: Detail of the sliding connection node, in the upper left corner of the front view shown in FIG. 7, in unlocked position, where:

Square (19) to control the turn of the connection strip (15), roof sheet (1), long left hand side wall (4), left door (6), sliding guide in the roof (11), turn bolt (18), turn bolt (20).

Figure 10:
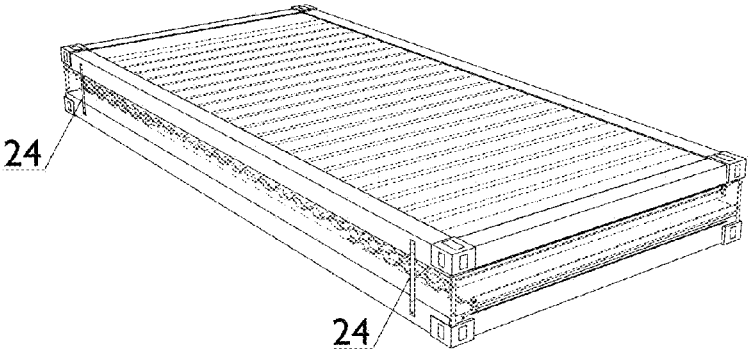

FIG. 10: Three-dimensional view of the container in the completely folded position, where:

Connection component (24) securing the container in the completely folded position.

Figure 11:
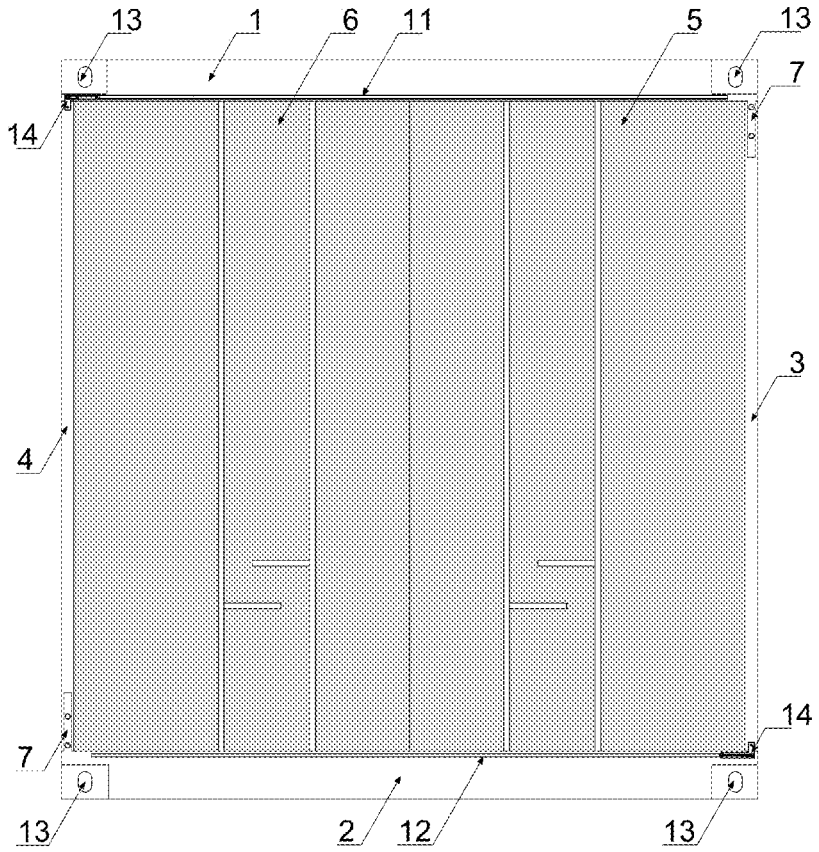

FIG. 11: Front view of the unfolded container with the doors closed, where:

Roof sheet (1), floor (2), long, right hand side wall (3), long left hand side wall (4), right door (5), left door (6), turn connection node (7), sliding guide in the roof (11), sliding guide in the floor (12), corner item for handling and transporting the container (13), turn and slide connection node (14).

Figure 12:
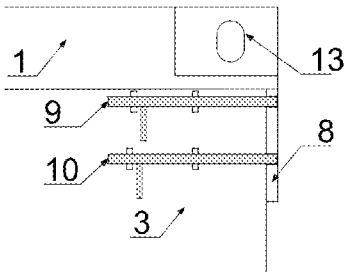

FIG. 12: Detailed side view of the interior of the turn connection node in the upper right corner of the container shown in FIG. 11, with the gudgeon pins (9 and 10) closed, where:

Roof sheet (1), long, right hand side wall (3), connection strip (8) of the turn node, corner item for handling and transporting the container (13).

Figure 13:
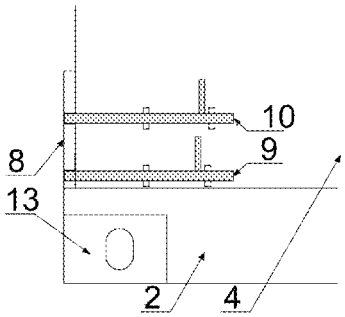

FIG. 13: Detailed side view of the interior of the turn connection node in the lower left corner of the container shown in FIG. 11, with the gudgeon pins (9 and 10) closed, where:

Connection strip (8) of the turn node, corner item for handling and transporting the container (13), floor (2), long left hand side wall (4).

Figure 14:
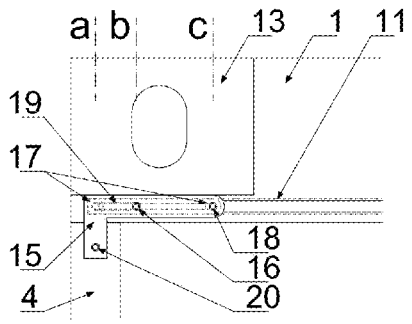

FIG. 14: Detailed front view of the turn and slide connection node (14) in the upper left corner of the container shown in FIG. 11, where:

Slider (17) within the guide (11), roof sheet (1), long left hand side wall (4), corner item for handling and transporting the container (13), square (19) to control the turn of the connection strip (15), turn bolt (18), turn bolt (20), locking pin (16) of the slide node.

Figure 15:
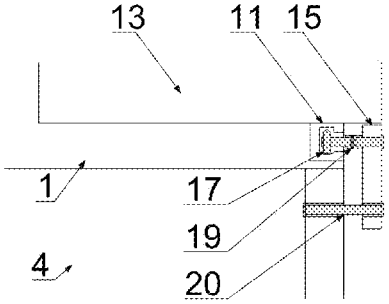

FIG. 15: Section "a" of FIG. 14, where:

Roof sheet (1), long left hand side wall (4), sliding guide in the roof (11), corner item for handling and transporting the container (13), square (19) to control the turn of the connection strip (15), turn bolt (20), slider (17).

Figure 16:
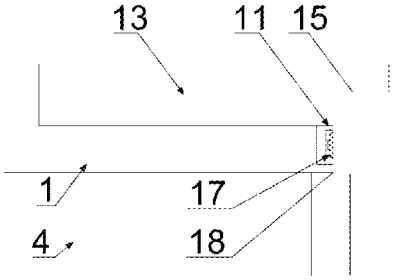

FIG. 16: Section "c" of FIG. 14, where:

Roof sheet (1), long left hand side wall (4), corner item for handling and transporting the container (13), sliding guide in the roof (11), connection strip (15), slider (17), turn bolt (18).

Figure 17:
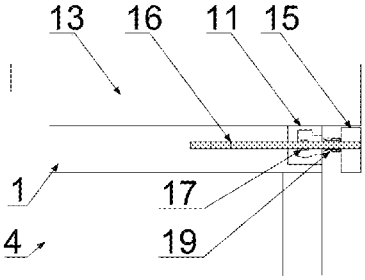

FIG. 17: Section "b" of FIG. 14, where:

Roof sheet (1), long left hand side wall (4), sliding guide in the roof (11), corner item for handling and transporting the container (13), connection strip (15), locking pin (16) of the slide node, square (19) to control the turn of the connection strip, slider (17).

Figure 18:
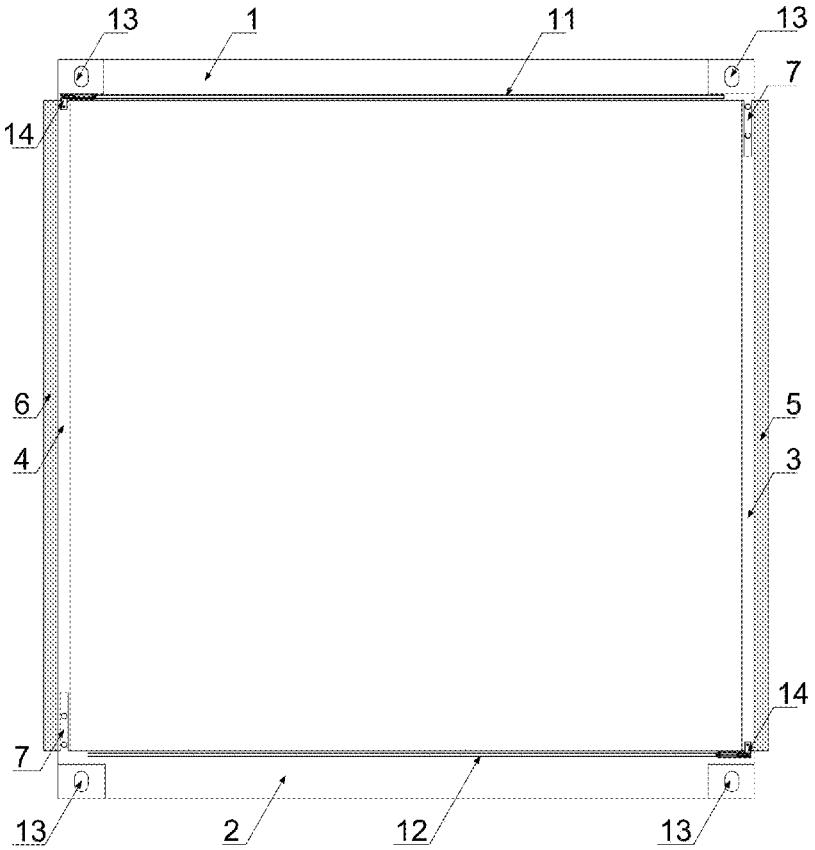

FIG. 18: Front view of the unfolded container with the doors (5 and 6) open outwards 270° and attached to the outside of the longer side walls (3 and 4), where:

Roof sheet (1), floor (2), sliding guide in the roof (11), sliding guide in the floor (12), corner item for handling and transporting the container (13), turn and slide connection node (14), turn connection node (7).

Figure 19:
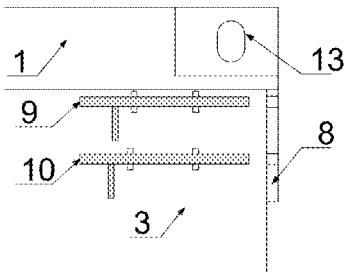

FIG. 19: Detailed side view of the interior of the turn connection node in the upper right corner of the container shown in FIG. 18, with the pins (9 and 10) open, where:

Roof sheet (1), long, right hand side wall (3), corner item for handling and transporting the container (13) and connection strip (8) of the turn node.

Figure 20:
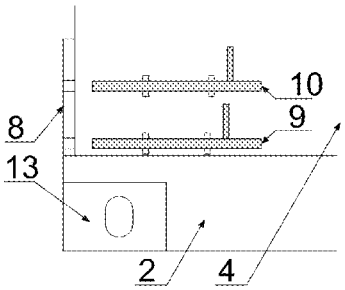

FIG. 20: Detailed side view of the interior of the turn connection node in the lower left corner of the container shown in FIG. 18, with the pins (9 and 10) open, where:

Corner item for handling and transporting the container (13), connection strip (8) of the turn node, floor (2), long left hand side wall (4).

Figure 21:
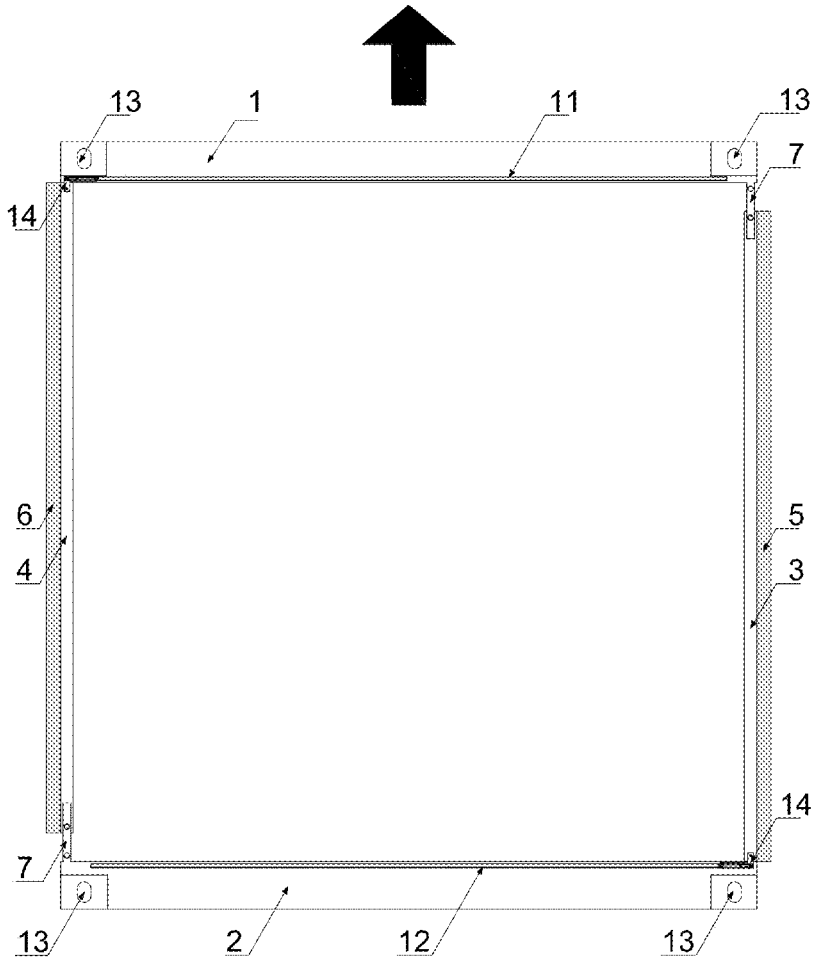

FIG. 21: Stage 1 of the vertical upward movement of the roof (1). Front view of the unfolded container with the doors (5 and 6) open outwards 270° and attached to the outside of the longer side walls (3 and 4), where:

Floor (2), turn connection node (7), sliding guide in the roof (11), sliding guide in the floor (12), corner item for handling and transporting the container (13), turn and slide connection node (14).

Figure 22:
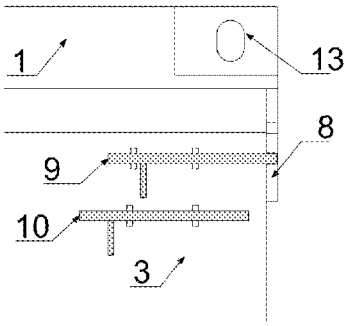

FIG. 22: Detailed side view of the interior of the turn connection node in the upper right corner of the container shown in FIG. 21 with the gudgeon pin (9) closed against the hole at the end of the connection strip (8), thus permitting turning of the side walls, where:

Roof sheet (1), long, right hand side wall (3), locking pin (10) open, corner item for handling and transporting the container (13).

Figure 23:
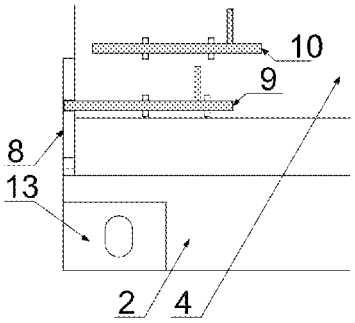

FIG. 23: Detailed side view of the interior of the turn connection node in the lower left corner of the container shown in FIG. 21, the gudgeon pin (9) closed against the hole at the end of the connection strip (8), thus permitting turning of the side walls, where:

Locking pin (10) unlocked, floor (2), long left hand side wall (4), corner item for handling and transporting the container (13).

Figure 24:
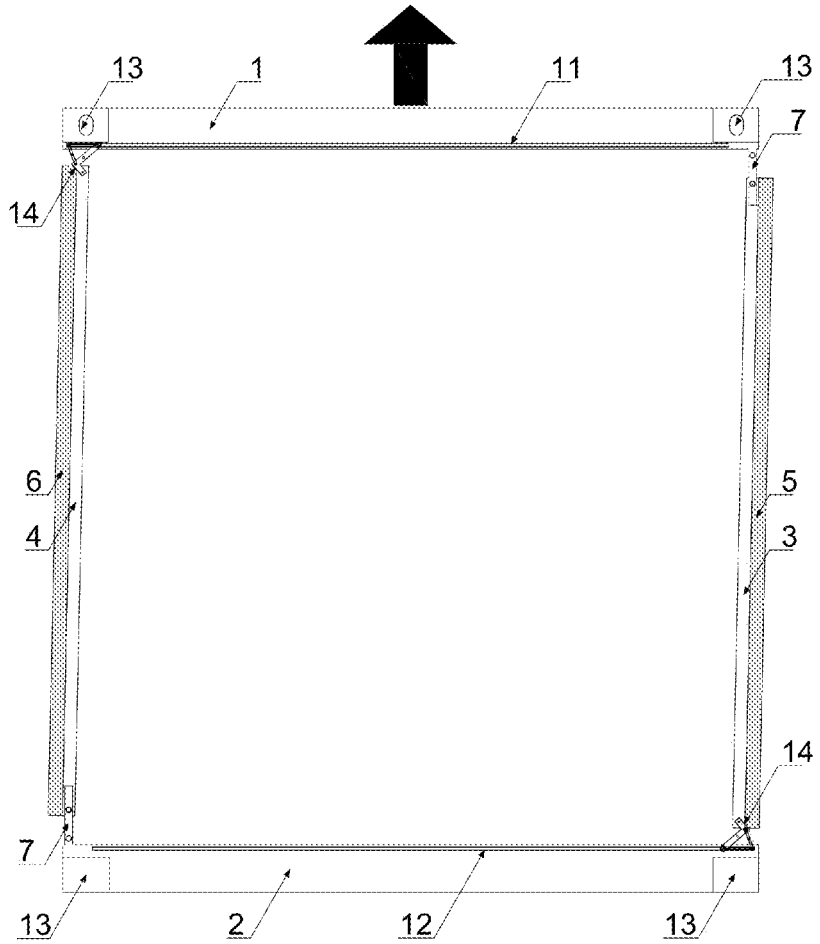

FIG. 24: Stage 2 of the vertical upward movement of the roof (1). Front view of the unfolded container with the doors (5 and 6) open outwards 270° and attached to the outside of the longer side walls (3 and 4). Unlocking of the slide node (14), where:

Floor (2), turn connection node (7), sliding guide in the roof (11), sliding guide in the floor (12), corner item for handling and transporting the container (13).

Figure 25:
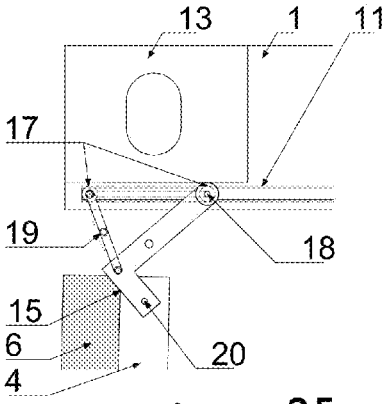

FIG. 25: Detailed front view of the slide connection node in the upper left corner of the container shown in FIG. 24, showing the node in an unlocked position, where:

Roof sheet (1), long left hand side wall (4), left door (6), sliding guide in the roof (11), corner item for handling and transporting the container (13), connection strip (15), slider (17), turn bolt (18), square (19) to control the turn, turn bolt (20).

Figure 26:
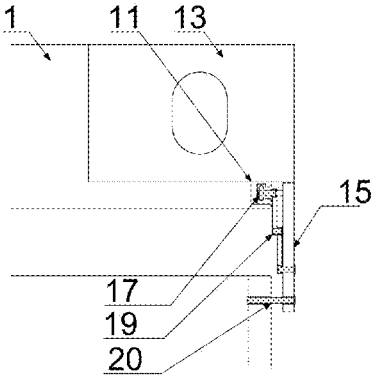

FIG. 26: Detailed section of the slide connection node shown in FIG. 25, where:

Roof sheet (1), corner item for handling and transporting the container (13), sliding guide in the roof (11), connection strip (15), slider (17), square (19) to control the turn, turn bolt (20).

Figure 27:
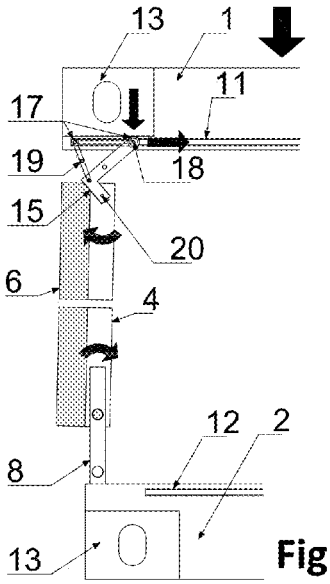

FIG. 27: Overcoming of the dead point at the start of the folding movement of the side wall (4) and door (6) attached to the outside of the side wall as a result of the forces generated by the downward movement of the roof (1) towards the floor (2), horizontal force against the slide node (14), side wall (4) and door (6) attached to the outside of the side wall. Furthermore:

Connection strip (8) of the turn node, sliding guide in the roof (11), sliding guide in the floor (12), corner item for handling and transporting the container (13), connection strip (15), slider (17), turn bolt (18), square (19) to control the turn, turn bolt (20).

Figure 28:
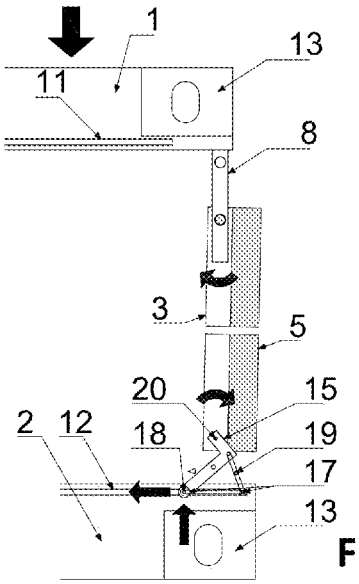

FIG. 28: Overcoming of the dead point at the start of the folding movement of the side wall (3) and door (5) attached to the outside of the side wall as a result of the forces generated by the downward movement of the roof (1) towards the floor (2), horizontal force against the slide node, side wall (3) and door (5) attached to the outside of the side wall, where:

Connection strip (8) of the turn node, corner item for handling and transporting the container (13), sliding guide in the roof (11), sliding guide in the floor (12), connection strip (15), slider (17), turn bolt (18), square (19) to control the turn, turn bolt (20).

Figure 29:
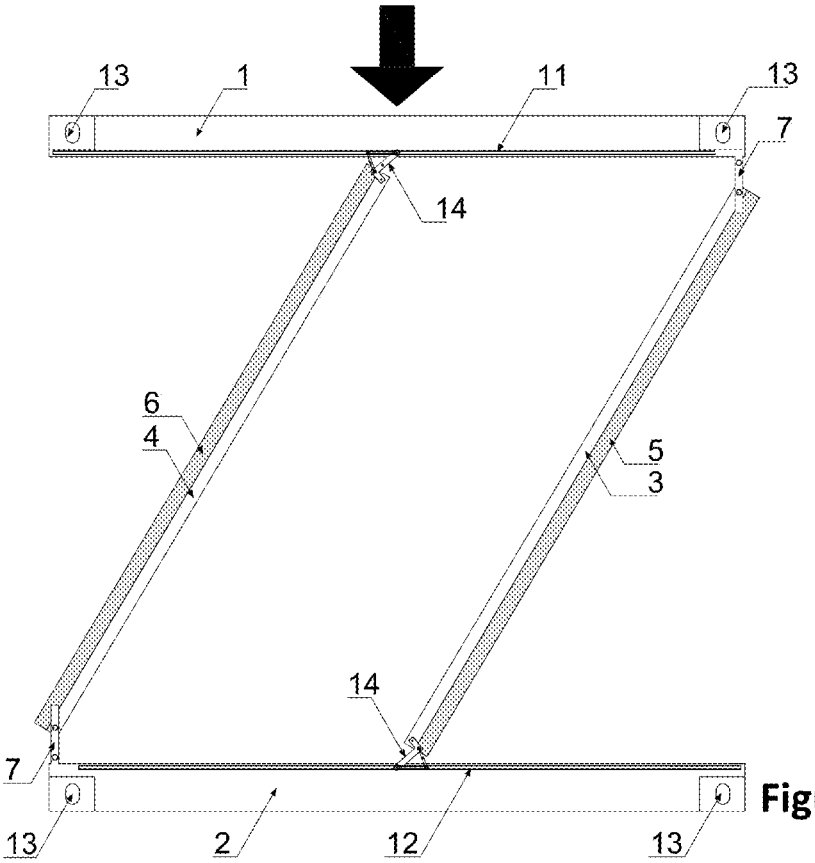

FIG. 29: Front view of the container in a partially folded position as a result of the movement of the roof (1) towards the floor (2), where:

Long, right hand side wall (3), long left hand side wall (4), right door (5), left door (6), turn connection node (7), sliding guide in the roof (11), sliding guide in the floor (12), corner item for handling and transporting the container (13), turn and slide connection node (14).

Figure 30:
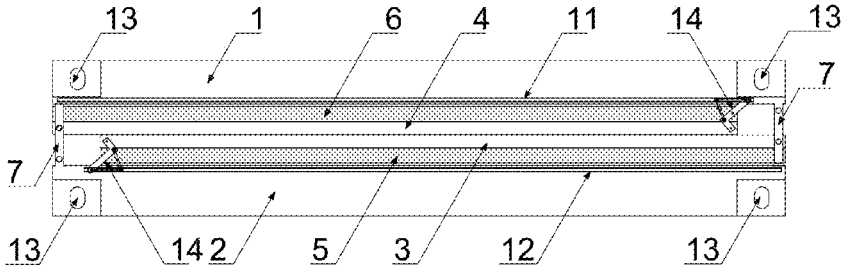

FIG. 30: Front view of the container in a completely folded position, where:

Roof sheet (1), floor (2), long, right hand side wall (3), long left hand side wall (4), right door (5), left door (6), turn connection node (7), sliding guide in the roof (11), sliding guide in the floor (12), corner item for handling and transporting the container (13), turn and slide connection node (14).

Figure 31:
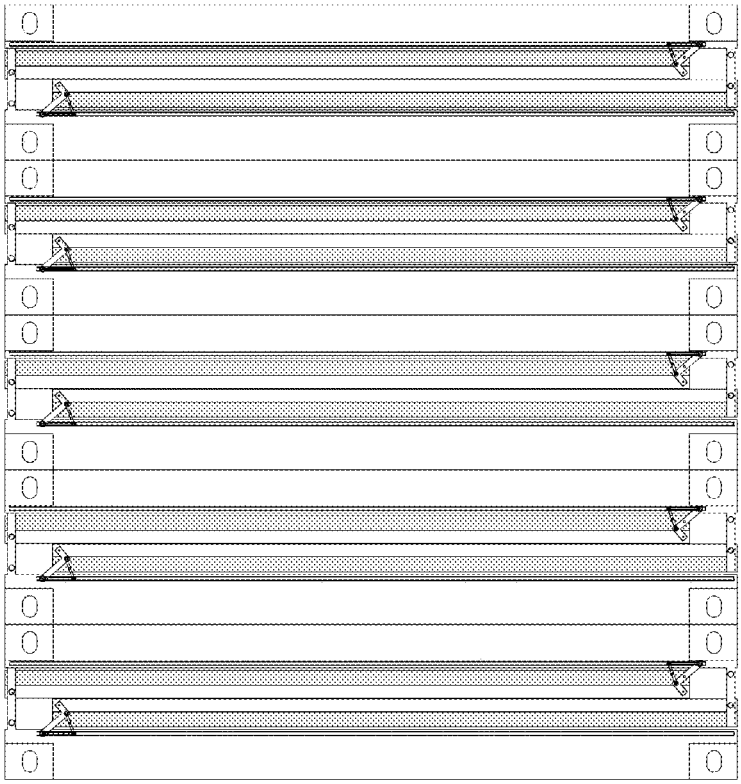

FIG. 31: Front view of several containers in a completely folded position arranged into a bundle of five containers within the area covered by one single unfolded container as shown in FIG. 11.

Figure 32:
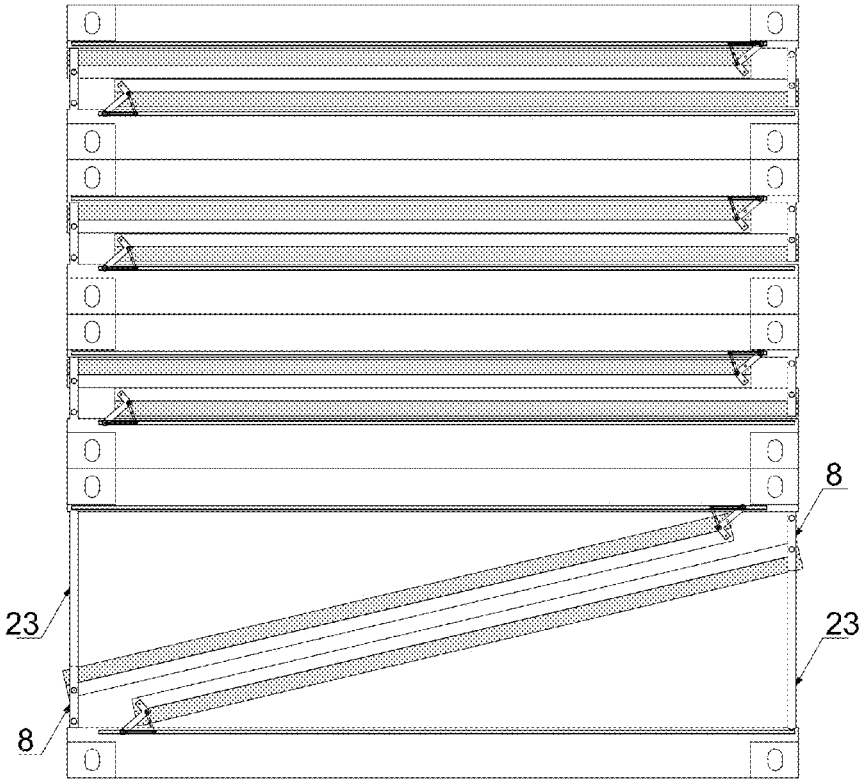

FIG. 32: Front view of several containers of which three are in a completely folded position and one is in a partially folded position arranged into a bundle of four containers within the area covered by one single unfolded container as shown in FIG. 11, where:

Additional piece (23) of the connection strip (8) to lock the container into a partially folded position.

Figure 33:
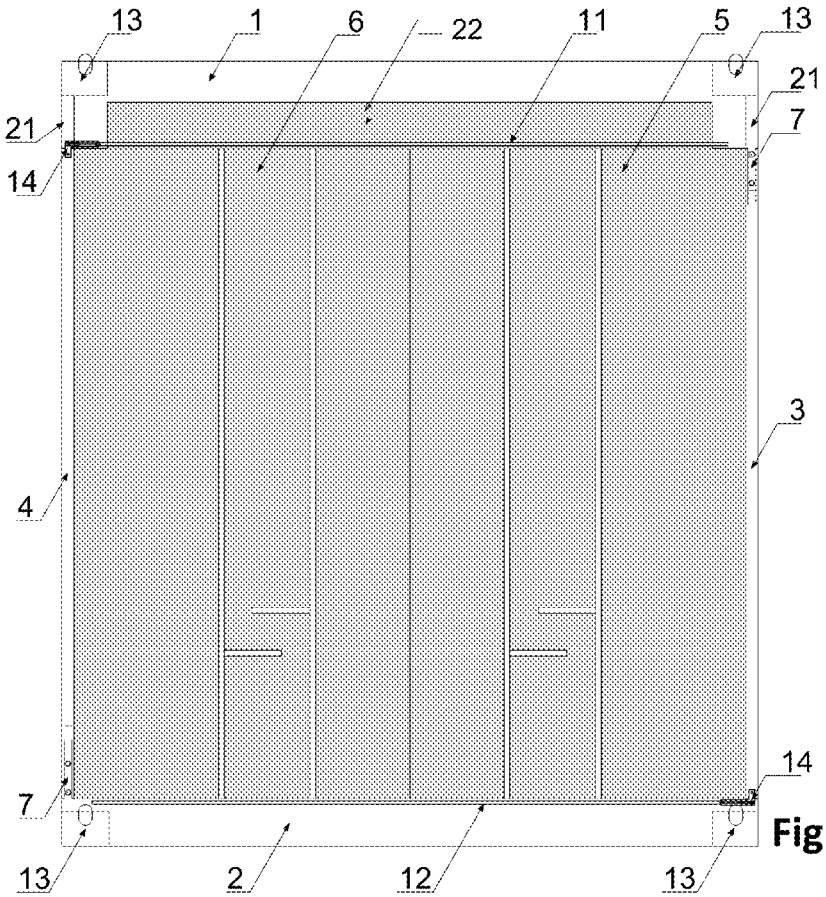

FIG. 33: Front view of an unfolded container with walls higher than the total container width and with the doors closed, where:

Fixed upper part (21) of the side walls forming a rigid piece with the roof (1), additional closing piece (22) in the upper part of the opening of the container on the front side, designed to close the opening above the doors (5 and 6), the height of which is equal to the width of the container. Floor (2), long, right hand side wall (3), long left hand side wall (4), turn connection node (7), locking pin (9), sliding guide in the roof (11), sliding guide in the floor (12), corner item for handling and transporting the container (13), turn and slide connection node (14).

Figure 34:
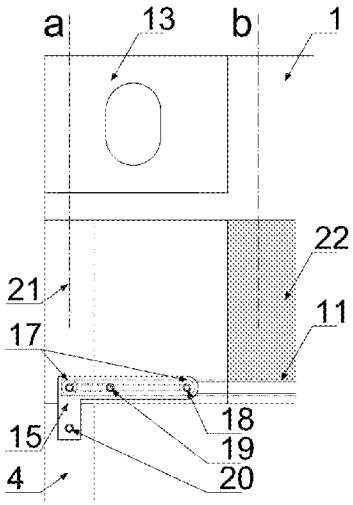

FIG. 34: Detailed front view of the slide connection node in the upper left corner of the container shown in FIG. 33, where:

Roof sheet (1), corner item for handling and transporting the container (13), Fixed upper part (21) of the side walls forming a rigid piece with the roof (1), additional closing piece (22), long left hand side wall (4), sliding guide in the roof (11), connection strip (15), slider (17), turn bolt (18), square (19) to control the turn, turn bolt (20).

Figure 35:
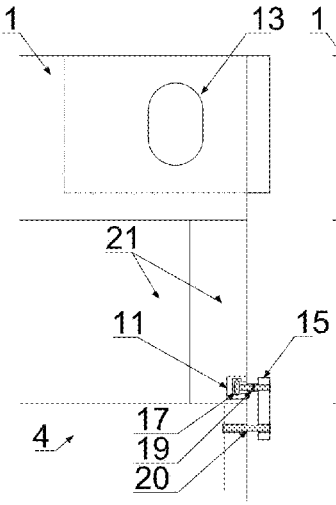

FIG. 35: Section "a" of FIG. 34, where:

Roof sheet (1), corner item for handling and transporting the container (13), Fixed upper part (21) of the side walls forming a rigid piece with the roof (1), long left hand side wall (4), sliding guide in the roof (11), slider (17), connection strip (15), square (19) to control the turn, turn bolt (20).

Figure 36:
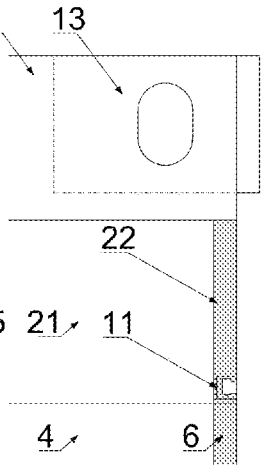

FIG. 36: Section "b" of FIG. 34. Detailed view showing the position of the upper guide (11) integrated in the additional closing piece (22), where:

Roof sheet (1), corner item for handling and transporting the container (13), Fixed upper part (21) of the side walls forming a rigid piece with the roof, long left hand side wall (4), left door (6).

Figure 37:
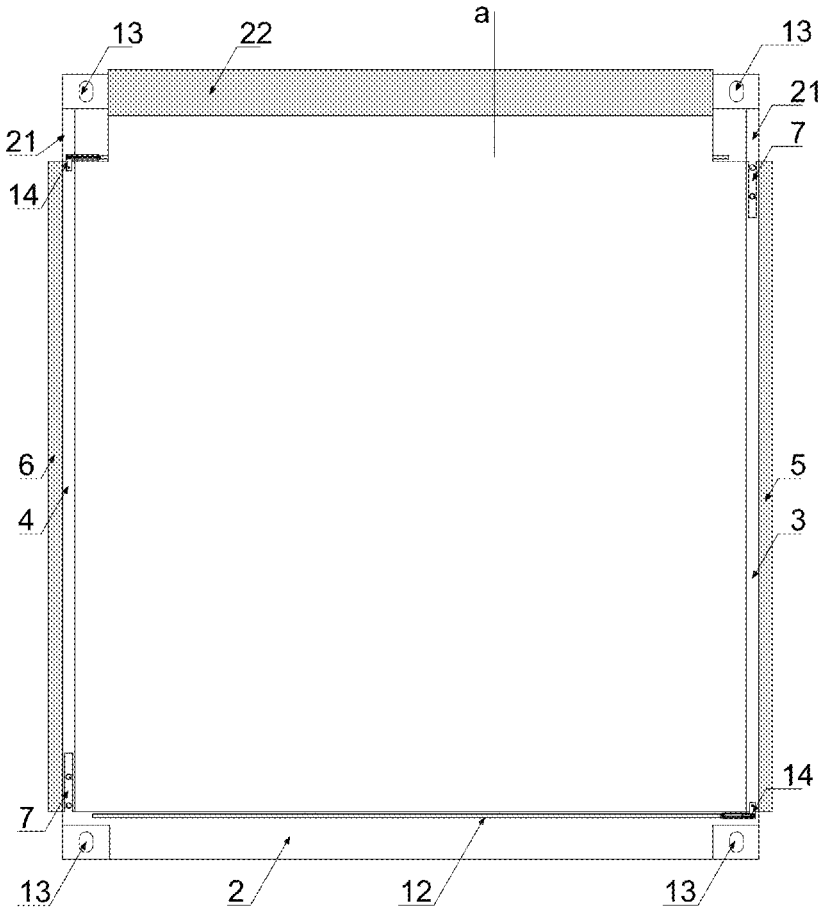

FIG. 37: Front view of the container shown in FIG. 33 with the doors (5 and 6) open 270° outwards and attached to the outside of the side walls (3 and 4), and additional closing piece (22) open outwards, attached to the side of the roof, where:

Floor (2), turn connection node (7), sliding guide in the floor (12), corner item for handling and transporting the container (13), turn and slide connection node (14), fixed upper part (21).

Figure 38:
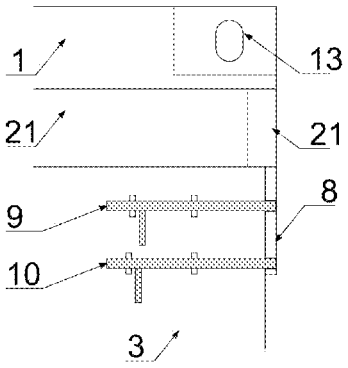

FIG. 38: Detailed side view of the interior of the turn connection node in the upper right corner of the container shown in FIG. 37, with the pins (9 and 10) closed, where:

Roof sheet (1), long, right hand side wall (3), corner item for handling and transporting the container (13), fixed upper part (21), connection strip (8).

Figure 39:
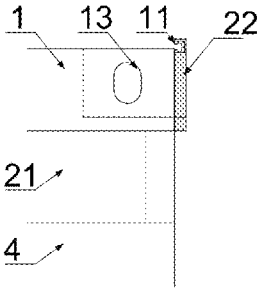

FIG. 39: Section "a" of FIG. 37 showing a detailed view of the opening of the additional closing piece (22). Furthermore:

Roof sheet (1), side wall (4), sliding guide in the roof (11), corner item for handling and transporting the container (13), fixed upper part (21) of side walls.

Figure 40:
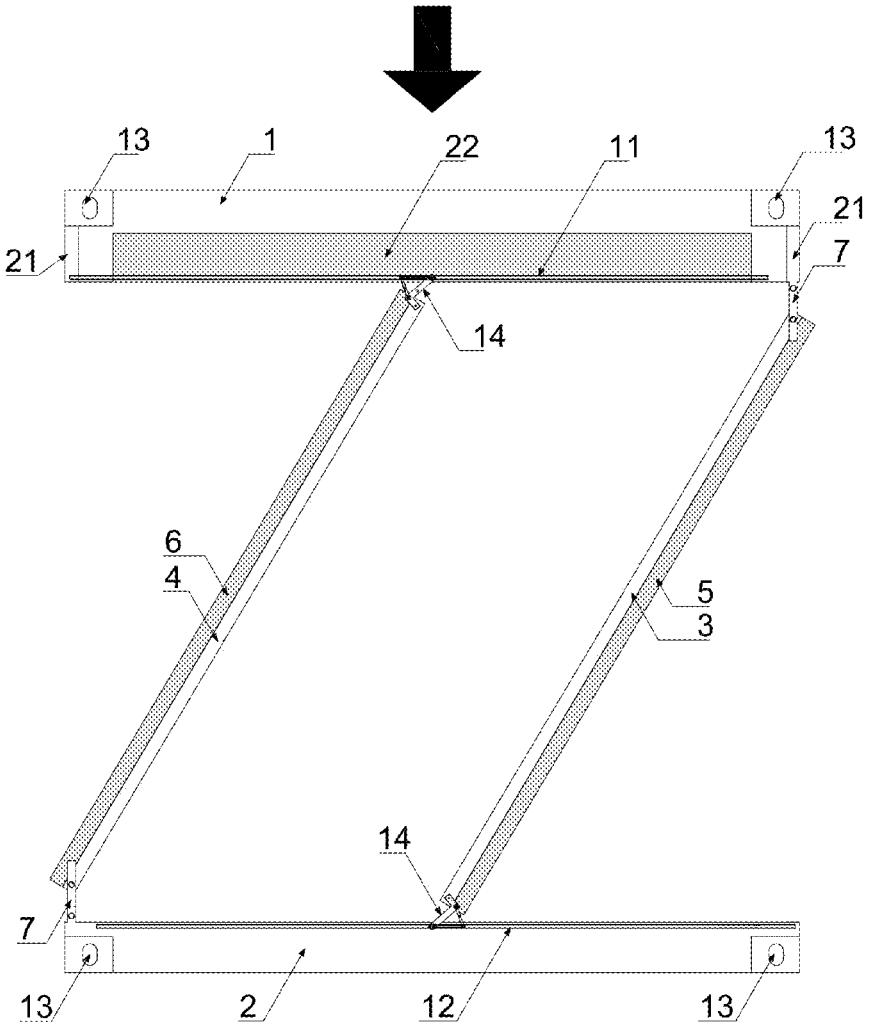

FIG. 40: Front view of the container shown in FIG. 33 in a partially folded position as a result of the movement of the roof (1) towards the floor (2), where:

Long, right hand side wall (3), long left hand side wall (4), right door (5), left door (6), turn connection node (7), sliding guide in the roof (11), sliding guide in the floor (12), corner item for handling and transporting the container (13), turn and slide connection node (14), fixed upper part (21), additional closing piece (22).

Figure 41:
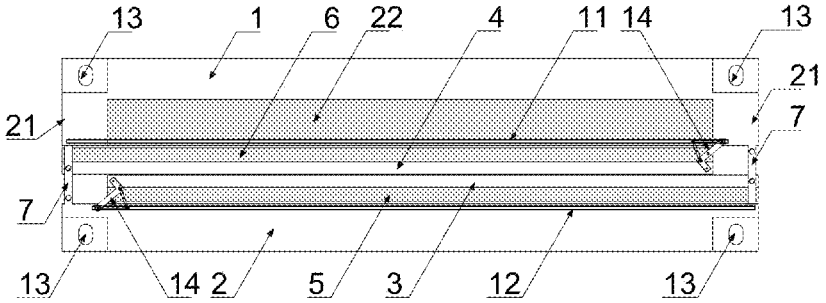

FIG. 41: Front view of the container in a completely folded position, where:

Roof sheet (1), floor (2), long, right hand side wall (3), long left hand side wall (4), right door (5), left door (6), turn connection node (7), sliding guide in the roof (11), sliding guide in the floor (12), corner item for handling and transporting the container (13), turn and slide connection node (14), fixed upper part (21) of the side walls, additional closing piece (22).

Figure 42:
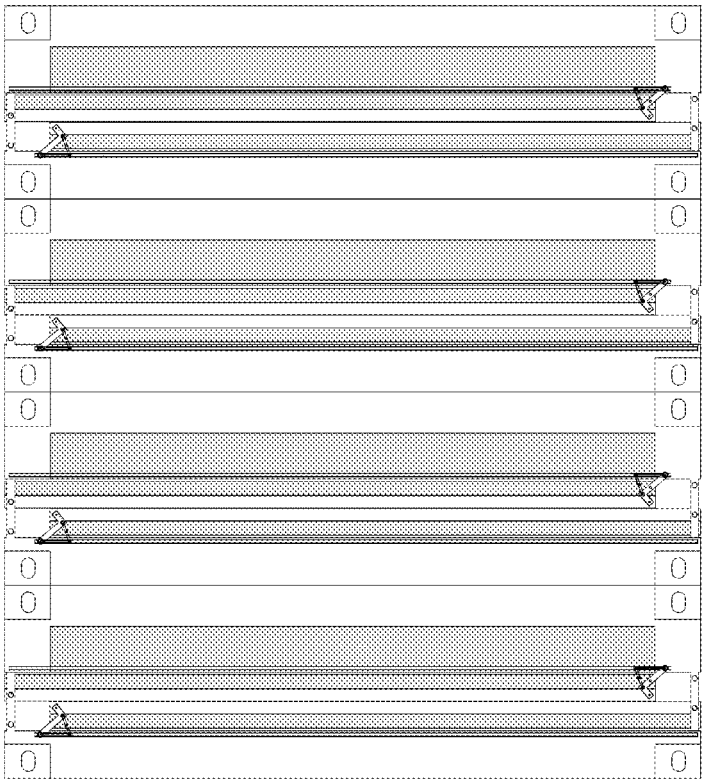

FIG. 42: Front view of several containers in a completely folded position arranged into a bundle of four containers within the area covered by one single unfolded container as shown in FIG. 33.

Figure 43:
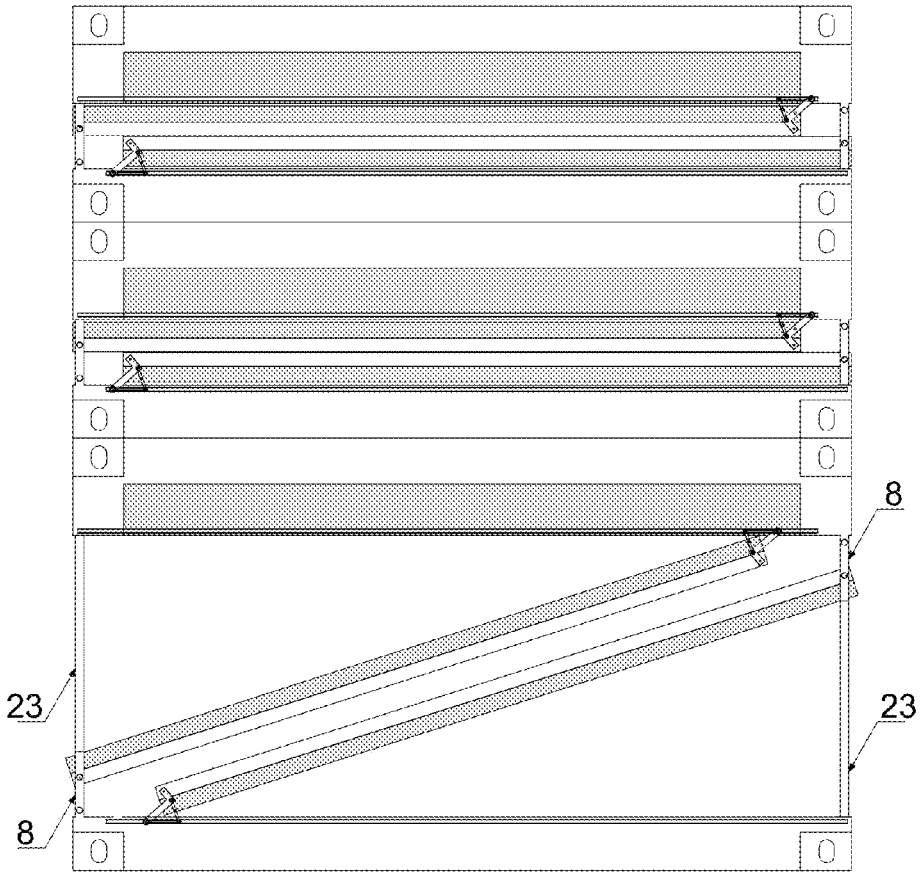

FIG. 43: Front view of several containers, of which two are in a completely folded position and one is in a partially folded position arranged into a bundle of three containers within the area covered by one single unfolded container as shown in FIG. 33. where:

Additional piece (23) of the connection strip (8), to secure the container into a partially folded position.

DESCRIPTION OF THE PREFERRED DESIGN

The preferred design is described as follows by way of example, with the materials to be used for manufacture of the new folding container being independent to the object of the invention, as are the methods of application and all accessory details that arise, providing they do not affect the essentials of the invention.

The preferred design method of the new folding container is provided:

In the preferred design the container is a replica of the standard ISO shipping container in terms of general components, although they are independent, individual parts, namely: roof (1), floor (2), side walls (3 and 4), front and rear doors (5 and 6). All these parts are connected via mechanisms that permit relative movement during the folding/unfolding stages, but remain locked when in the upright position or when in use.

In the preferred design, the folding container comprising the object of this invention is fitted with doors on the front and the rear of the container, in both cases with the doors covering half the container width, and opening in the same way as standard ISO containers, i.e. outwards from the container, FIGS. 1 and 4. The doors are fitted with the subsequent conventional closing/locking devices, which also mean that the closed doors have a lateral bracing effect on the container. The conventional watertight seals have been planned located along the contact lines between the sheets to guarantee the seal.

On the four corners of the container there are two different types of connection nodes, at least on the front and rear, which can be reproduced at any intermediate section. The description is centred on the front with the same solution being applicable to the rear. There are two turn connection nodes (7), and another two turn and slide connection nodes (14) fitted with the relevant locking systems to guarantee stability and mechanical strength of the structure in the unfolded position, but at the same time permitting movement for folding the container once unlocked. The description of these nodes and their role in the folding/unfolding of the container are described as follows:

There are two turning nodes (7) on the facing side on two of the corners, diagonally opposite each other, with the turn and slide nodes (14) positioned on the other two corners, FIG. 29. This layout of the connection nodes is repeated on the rear side of the container, and can be reproduced at any intermediate section.

With the container in the unfolded position, i.e. ready to be used for goods and transport, with the walls in the vertical position, the locking mechanism, with gudgeon pins (9 and 10), FIGS. 2, 4 and 5, ensures the rigidity of the edges of contact between the parts of the container, so that the strength of the container is improved against horizontal forces, FIGS. 1 and 11. The container is designed to be fitted with the conventional watertight seals along these lines of contact in order to guarantee the container remains sealed during use.

The turning connection nodes (7), FIG. 5, consist of connection strips (8) with at least two holes, which in combination with at least two conventional gudgeon pins (9 and 10) comprise the locking system.

In the upright position, FIGS. 11 and 18, the locking system in the turn connection nodes (7) is preferably achieved with two closed pins (9 and 10). The relative position of the side walls with regards to the floor and roof is fixed in this situation, FIGS. 12 and 13, in that securing takes place at two points. Locking force torques are mobilised in them that prevent relative turning of one part with regards the other, thus producing a butting node. When pins 9 and 10 (FIGS. 19 and 20) are removed, unlocking the system, the side walls 3 and 4 can be displaced vertically with regards the floor (2) and roof (1) respectively, FIGS. 6 and 21. With the vertical movement of the roof, relative movement between the floor and the side walls takes place until the point where pin 9 is aligned with the turn position is reached (FIGS. 22 and 23). This locking system of the preferred design eventually has one single securing point, since the pin is only effective when closed. In this position securing is only at one point and permits the relative turn of one part with regard the other, producing an articulated node, FIG. 8. In this position the side walls can turn with regards the floor and roof respectively, at the turn nodes (7).

The turn and slide connection nodes (14) at the ends of the side walls opposite the turning nodes (7), FIGS. 1 and 7, consist of conventional means such as a slider (17) with a least one bearing inside the guide (11 and 12) arranged on the side edge of the adjacent surface, whether floor or roof, which joins the adjacent side wall through the double-jointed connection strip (15), which permits relative turn at the connection with the side wall and a limited turn in the connection with the sliding roller. This takes place so that this connection strip (15) is connected to the slider (17) by means of a conventional bolt (18) that permits relative turn, and connected to the adjacent side wall (3 and 4) by another conventional bolt (20) that also permits relative turn. Moreover, there is a relative turn limiter with the sliding roller, which in the preferred design takes place by means of a square of articulate bars (19) so that the walls more with regards to the floor and roof in a controlled manner. FIGS. 14, 15 and 16.

Locking of the movement at this turn and slide node (14) is achieved by a pin (16), FIGS. 3 and 17, with three positions, that permits a first position to prevent turning and sliding, the second position prevents sliding and with the pin removed completely in the third position both movements are permitted to fully unlock the turn and slide node (14), FIGS. 25 and 26. In preferred design, the opening on the guides 11 and 12 faces towards the outer sides of the floor and roof.

With the sliding roller being prevented from sliding, with the vertical relative movement of the side walls with regards the floor and roof, the connection undergoes a relative turn, with the end of the wall (3 and 4) detaching from the adjacent guide (11 and 12). This movement is produced by the articulated connection of the strip (15) with the side wall in the turn bolt (20). In this position it is now ready to permit sliding of the bearings along the inside of the guides, by removing locking pin (16).

This turn and slide connection node (14) described like this, enables folding of the side wall in conjunction with the adjacent door opened onto the outer face, sliding the turn and slide connection node towards the inside of the container without collision between the ends of the assembly and the floor taking place at a node, or with the roof in the diagonally opposite direction.

In this preferred design, once the relative movement of the side walls with regard the floor and roof has been completed, and the turn and slide movements have been unlocked in the relevant connection nodes, the position reached by the side walls is not exactly vertical, but on a slight tilt (FIGS. 27 and 28). In this position, the side walls act as double-jointed bars, with the sliding of one of the ends being unhindered. The state of oblique forces produced when the downward vertical movement of the roof starts, makes the sliding node generate a horizontal force not forced by the sliding roller since the movement of the latter is locked. Consequently, only with the vertical movement of the roof towards the floor, we overcome the dead point of movement and achieve mobilisation of the container folding stage. In FIG. 29 a partially folded position of the container can be seen. In FIG. 30 the completely folded position of the container can be seen.

In the preferred design, the vertical movement of the roof can be achieved using any conventional piece of machinery used in the sector, since the container is fitted with the usual edge pieces (13) which are the usual handling and lifting devices of standard ISO containers.

To return to the unfolded position, the same steps are followed in reverse order.

Containers in the folded position can be stacked and connected using conventional securing methods, such as threaded fixings, through the corner pieces to make bundles that can be handled as a single unit. In order to comply with standard measurements, in the size of a standard ISO container, up to five folded containers can be stacked.

In order to form bundles of stacked containers, adapted to the size of standard ISO containers, a number of stacked containers less than five additional connection pieces (23), such as threaded bars, can be arranged in the connection couplings, that can keep containers in partially folded position to make bundles of four or three containers.

Moreover, the contact lines between surfaces are fitted with connectors and seals to ensure the impermeability of containers in the unfolded position.

Considering that the description and the attached pictures have proved and described a preferred design for this invention, it should be obvious to experts in the field that several changes can be made to the invention without affecting the scope of it.

What is claimed is:

1. A container that is foldable between a folded position and an unfolded position, the container comprising:

(a) a roof comprising first and second sliding guides;

(b) a floor comprising third and fourth sliding guides;

(c) first and second sidewalls;

(d) a front door and a rear door;

(e) first and second turn means for connecting a bottom part of the first sidewall to the floor and for permitting pivoting of the first sidewall relative to the floor when the container is folded between the unfolded and folded positions, and third and fourth turn means for connecting a top part of the second sidewall to the roof and for permitting pivoting of the second sidewall relative to the roof when the container is folded between the unfolded and folded positions, wherein each of the first, second, third and fourth turn means comprises (i) a connection member comprising a plurality of holes and (ii) a plurality of pins, wherein respective of the plurality of pins are selectively insertable into respective holes in respective of the connection members in any of a plurality of configurations, including a locked configuration in which the container is locked in the unfolded position in the shape of a parallelepiped with the bottom part of the first sidewall abutting the floor and the top part of the second sidewall abutting the roof and the respective pins preventing pivoting of the first and second sidewalls relative to the floor and roof respectively, and an unlocked configuration in which the container is not locked in the unfolded position and in which the bottom part of the first sidewall is spaced from the floor and the top part of the second sidewall is spaced from the roof and respective of the plurality of pins act as a pivot around which each of the first and second sidewalls can turn;

(f) first and second slide means for connecting a top part of the first sidewall to the roof and for permitting turning and sliding of the first sidewall relative to the roof when the container is in the unlocked configuration, and third and fourth slide means for connecting a bottom part of the second sidewall to the floor and for permitting turning and sliding of the second sidewall relative to the floor when the container is in the unlocked configuration, wherein each of the first, second, third and fourth slide means comprises (i) a connection strip, (ii) means for pivotally attaching the connection strip to the first or second sidewall; (iii) a sliding member joined to the connection strip for sliding in the first, second, third or fourth sliding guide, and (iv) pin means removably insertable into a hole in the connection strip in each of the first, second, third and fourth slide means for preventing sliding of the first and second sidewalls relative to the floor and roof respectively when the container is in the locked configuration;

wherein with the container in the unfolded position each of the front and rear doors is pivotable to a position abutting an external surface of one of the first or second sidewalls, and wherein the container is constructed and arranged such that, with the container in the unfolded position and in the unlocked configuration and with the bottom part of the first sidewall spaced from the floor and the top part of the second sidewall spaced from the roof, a vertical force applied from a top of the roof toward the floor will cause the container to fold into the folded position with the first and second sidewalls and the front and rear doors lying flat atop the floor and with the roof lying flat atop the first and second sidewalls and the front and rear doors.

2. The container according to claim 1, comprising a plurality of front doors and a plurality of rear doors, wherein a first front door of the plurality of front doors and a first rear door of the plurality of rear doors is pivotable to a position abutting an external surface of the first sidewall and a second front door of the plurality of front doors and a second rear door of the plurality of rear doors is pivotable to a position abutting an external surface of the second sidewall.

3. The container according to claim 2, wherein the connection strip of each of the first, second, third and fourth turn means comprises two holes into which the pin means is removably insertable, including a first hole into which insertion of the pin means prevents the respective first or second sidewall from sliding and turning, and a second hole into which insertion of the pin means only prevents the respective first or second sidewall from sliding.

4. The container according to claim 2, wherein the connection strip of each of the first, second, third and fourth slide means comprises a slider and is joined to the slider by a turn bolt that permits turning of the connection strip.

5. The container according to claim 4, wherein the connection strip of each of the first, second, third and fourth slide means comprises an articulated rod to control turning of the connection strip.

6. The container according to claim 2, wherein the slider of each of the first, second, third and fourth slide means comprises a bearing.

7. A combination comprising five (5) of the containers according to claim 2 in the folded position and stacked to occupy a space that of one of the containers occupies in an unfolded position.

8. The container according to claim 2, comprising a plurality of struts securing the container in a partially folded position.

9. A combination comprising a plurality of containers according to claim 8 that are stacked together with each of the containers in the partially folded position.

10. The container according to claim 2, wherein the first and second sidewalls have a height that is greater than a width of the container and the first and second front doors and the first and second rear doors are dimensioned to close only a portion of respective openings in a front and rear of the container with the container in the unfolded position and the front and rear doors in a closed position, the roof of the container comprising a plurality of closing pieces that are hingedly connected to a remainder of the roof at the front and rear of the container, said plurality of closing pieces being dimensioned to cover a remainder of the respective openings in the front and rear of the container not covered by the front and rear doors with the front and rear doors in the closed position.

11. A combination comprising four (4) of the containers according to claim 10 in the folded position and stacked to occupy the space of one of the containers in an unfolded position.

12. The container according to claim 10, comprising a plurality of struts securing the container in a partially folded position.

13. A combination comprising a plurality of the containers according to claim 12 that are stacked together with each of the containers in the partially folded position.

14. A method comprising the steps of:

(a) providing the container of claim 2 with the container in the unfolded position and in the locked configuration;

(b) removing respective of the pins from the turn means and from the slide means respectively to permit lifting of the roof relative to a rest of the container;

(c) lifting the roof vertically in a direction away from the floor and inserting respective of the plurality of pins in the respective holes in the turn means respectively to place the container in the unlocked configuration; and (d) applying a vertical force from the roof toward the floor to cause the container to collapse into the folded configuration.

15. A container that is foldable between a folded position and an unfolded position, the container comprising:

(a) a roof;

(b) a floor;

(c) a first sidewall of rectangular shape comprising a plurality of first portions on opposing ends of a bottom part of the first sidewall and a plurality of second portions on opposing ends of a top part of the first sidewall;

(d) a second sidewall of rectangular shape comprising a plurality of first portions on opposing ends of a top part of the second sidewall and a plurality of second portions on opposing ends of a bottom part of the second sidewall;

(e) a front door;

(f) a rear door;

(g) first means for selectively connecting respective first portions of the first and second sidewalls to the floor and roof respectively in any of a plurality of configurations, including a locked configuration wherein the first and second sidewalls are locked in abutting relationship to the floor and roof respectively and an unlocked configuration wherein the first and second sidewalls are spaced from, and are pivotable with respect to, the floor and roof respectively; and (h) second means for selectively connecting respective second portions of the first and second sidewalls to the roof and floor respectively in any of a plurality of configurations, including a non-sliding configuration wherein the first and second sidewalls are prevented from sliding with respect to the roof and floor respectively and a sliding configuration wherein the first and second sidewalls are slidable with respect to the roof and floor respectively;

wherein, in the unfolded position, the container is a parallelepiped in which the respective first portions of the first sidewalls are cater-corner to the respective first portions of the second sidewall and the respective second portions of the first sidewall are cater-corner to the respective second portions of the second sidewall;

wherein in the folded position the first and second sidewalls and front and rear doors lie flat atop the floor and the roof lies flat atop the first and second sidewalls and front and rear doors; and wherein, with the container in the unfolded configuration, with the front and rear doors in an open position and abutting respective exterior surfaces of the first and second sidewalls, with the first means connecting the respective first portions of the first and second sidewalls to the floor and roof respectively and the second means connecting the respective second portions of the first and second sidewalls to the roof and floor respectively, a vertical force applied to a top of the roof in the direction of the floor causes the respective first portions of the first and second sidewalls to pivot with respect to the floor and roof respectively and the respective second portions of the first and second sidewalls to slide with respect to the roof and floor respectively so as to cause the container to collapse into the folded position.

16. A container that is foldable between a folded position and an unfolded position, the container comprising:

(a) an upper part comprising (i) a roof, (ii) a first side upper part, (iii) a second side upper part, (iv) a front closing portion, and (v) a rear closing portion, wherein the first and second upper part and the front and rear closing portions form a rigid piece with the roof;

(b) a floor;

(c) a first sidewall of rectangular shape comprising a plurality of first portions on opposing ends of a bottom part of the first sidewall and a plurality of second portions on opposing ends of a top part of the first sidewall;

(d) a second sidewall of rectangular shape comprising a plurality of first portions on opposing ends of a top part of the second sidewall and a plurality of second portions on opposing ends of a bottom part of the second sidewall;

(e) a front door and a rear door;

(f) first means for selectively connecting respective first portions of the first and second sidewalls to the floor and the second side upper part respectively in any of a plurality of configurations, including a locked configuration wherein the first and second sidewalls are locked in abutting relationship to the floor and the upper part respectively and an unlocked configuration wherein the first and second sidewalls are spaced from, and are pivotable with respect to, the floor and the second side upper part respectively; and (g) second means for selectively connecting respective second portions of the first and second sidewalls to the first side upper part and floor respectively in any of a plurality of configurations, including a non-sliding configuration wherein the first and second sidewalls are prevented from sliding with respect to the upper part and floor respectively and a sliding configuration wherein the first and second sidewalls are slidable with respect to the upper part and floor respectively;

wherein, in the unfolded position, the container is a parallelepiped in which the respective first portions of the first sidewalls are cater-corner to the respective first portions of the second sidewall and the respective second portions of the first sidewall are cater-corner to the respective second portions of the second sidewall;

wherein in the folded position the first and second sidewalls and front and rear doors lie flat atop the floor and the upper part lies flat atop the first and second sidewalls and front and rear doors; and wherein, with the container in the unfolded configuration, with the front and rear doors in an open position and abutting respective exterior surfaces of the first and second sidewalls, with the first means connecting the respective first portions of the first and second sidewalls to the floor and second side upper part respectively and the second means connecting the respective second portions of the first and second sidewalls to the first side upper part and floor respectively, a vertical force applied to a top of the roof in the direction of the floor causes the respective first portions of the first and second sidewalls to pivot with respect to the floor and upper part respectively and the respective second portions of the first and second sidewalls to slide with respect to the upper part and floor respectively so as to cause the container to collapse into the folded position.

17. The container according to claim 16, wherein a width of each of the front and rear doors is substantially equal to one half of a height of the front and rear doors, rendering the height of the front and rear doors substantially equal to a width of the container.

* * * * *